US009662905B2

(12) United States Patent
Koers et al.

(10) Patent No.: US 9,662,905 B2
(45) Date of Patent: May 30, 2017

(54) DEVICE AND METHOD FOR DRYING PRINTED CONTAINERS

(71) Applicant: KHS GmbH, Dortmund (DE)

(72) Inventors: Sascha Koers, Bergkamen (DE); Katrin Preckel, Gelsenkirchen (DE); Werner Van De Wynckel, Humbeek (BE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 15/125,669

(22) PCT Filed: Mar. 12, 2015

(86) PCT No.: PCT/EP2015/055162
§ 371 (c)(1),
(2) Date: Sep. 13, 2016

(87) PCT Pub. No.: WO2015/136033
PCT Pub. Date: Sep. 17, 2015

(65) Prior Publication Data

US 2017/0001450 A1 Jan. 5, 2017

(30) Foreign Application Priority Data

Mar. 13, 2014 (DE) ..... 10 2014 103 407

(51) Int. Cl.
*B41J 11/00* (2006.01)

(52) U.S. Cl.
CPC ..... *B41J 11/002* (2013.01)

(58) Field of Classification Search
CPC ..... B41J 2/2114; B41J 11/00; B41J 11/0015; B41J 11/002
See application file for complete search history.

(56) References Cited

U.S. PATENT DOCUMENTS

| | | | | |
|---|---|---|---|---|
| 2010/0192517 | A1* | 8/2010 | Schach | B41J 11/0015 53/411 |
| 2010/0238247 | A1* | 9/2010 | Doo | B41J 11/002 347/102 |
| 2013/0222479 | A1* | 8/2013 | Houjou | B41J 11/002 347/40 |
| 2014/0002558 | A1 | 1/2014 | Ramesh et al. | |

FOREIGN PATENT DOCUMENTS

| | | |
|---|---|---|
| DE | 10 2007 036 752 | 2/2009 |
| DE | 10 2010 062 144 | 5/2012 |
| DK | 177499 | 7/2013 |
| WO | WO04/000936 | 12/2003 |
| WO | WO2010/034375 | 4/2010 |
| WO | WO2013/029711 | 3/2013 |

* cited by examiner

*Primary Examiner* — Kristal Feggins
(74) *Attorney, Agent, or Firm* — Occhiuti & Rohlicek LLP

(57) ABSTRACT

A container-handling station includes a drying-and-curing device that dries a printed region on a container. A sensor is configured detects heat energy from this reaction during a sensing interval that is between 50 milliseconds and 1 millisecond per angular degree of the container surface.

21 Claims, 7 Drawing Sheets

DEVICE AND METHOD FOR DRYING PRINTED CONTAINERS

RELATED APPLICATIONS

This is the national stage, under 35 USC 371, of PCT/EP2015/055162, filed on Mar. 12, 2015, which claims the benefit of the Mar. 13, 2014 priority date of German application DE 10 2014 103 407.4, the contents of which are herein incorporated by reference.

FIELD OF INVENTION

The invention relates to a device for drying printed containers and to a method for determining the degree of dryness of printed containers.

BACKGROUND

Known devices for printing on packages include those that apply a colored or multi-colored print to the package. Such printing devices typically include a transport path on which printing takes place using printing units or print heads along the transport path that produce the color sets. Typical print heads are those that can be actuated electrically or electronically, such as inkjet or tonejet print heads. In the latter case, the print head applies directly to the container wall via direct printing, thus producing the printed image.

It is also known to include drying and curing devices. These are used to dry or cure a freshly printed container. However, in the known printing devices, the degree of dryness, and thus the degree of curing of the printing ink, cannot be determined directly within the process.

One disadvantage of this is that unless the printing ink that has been fully cured, the printed image applied to the container wall may smudge after awhile due to contact with other containers or parts of the machine. This leads to a printed image quality that is impaired overall Another disadvantage arises because the drying and/or curing of the printing ink greatly influences its ability to migrate through the container wall into the container interior. Thus, improper drying or curing also creates the risk of printing ink, or constituents thereof, migrating into the product contained within the container.

SUMMARY

It is an object of the invention to provide a device by means of which the monitoring of the drying reaction of the printed container is possible, in particular, an inline monitoring, that is to say a monitoring of the state of dryness of the printing ink during the movement of the container.

The invention relates firstly to a device for drying printed containers comprising a transport element that can be driven in rotation with container handling stations provided thereon, wherein the containers held at the container handling stations are moved by the transport element on an intrinsically closed movement path between at least one container feed and at least one container discharge.

The transport element may, for example, be a rotor that is driven in rotation about a vertical machine-axis, in particular, a rotor that is continuously driven in rotation. Of course, other types of transport elements are also possible, for example transport belts or transport chains operating in steps or continuously. The container handling stations may be, for example, combined printing and drying stations in which both the printing and the drying or curing of the printing ink is brought about. In this case, the container handling stations additionally have, besides a drying and curing device, at least one application head (in particular a print head), by means of which the printing or a coating, that is to say the formation of a base coat or top coat takes place. However, the container handling stations may also be configured as drying stations at which containers that have already been printed are subjected only to a drying or curing.

The container handling stations are, in this case, each assigned at least one drying and curing device for bringing about a drying reaction on the printed containers. Also provided is a sensor that is designed to detect the heat energy or heat radiation or the temperature that is emitted from the container being subjected to the drying and curing reaction. In particular, the sensor determines the temperature of the container in the region of the printed image applied to the container. This determination of the heat energy preferably takes place in a contactless manner, for example, through the IR radiation emitted from the container or the printed image located thereon. The determination of the heat energy emitted from the printed container also preferably takes place during the movement of the container by the transport element. Therefore, in an associated evaluation unit, the degree of dryness or curing of the printing ink (degree of curing) can be determined, namely, in particular inline, that is to say, during ongoing operation of the drying and curing device as a correlation to the emitted heat energy or heat radiation (curve over time).

According to one embodiment of the invention, the drying and curing devices are designed to bring about an exothermic drying and curing reaction on the printed container, and the sensor is designed to determine the heat energy that is emitted from the container and is brought about by the exothermic drying and curing reaction. The invention is based on the knowledge that particularly by UV irradiation of the printed image by suitable emitters of the drying and curing device, a chemical drying reaction and curing reaction is triggered, so called pinning or curing, which proceeds exothermically, that is to say, heat energy is released during the course of the chemical reaction. Based on this knowledge, it is possible to determine whether the drying reaction has been initiated. Furthermore, the degree or intensity of the initiated drying reaction can also be determined, and thus conclusions can be drawn about the curing of the printing ink at the end of the drying process. Preferably, the drying reaction is merely initiated by the drying and curing device, that is to say the action of the drying and curing device on the containers is merely an activation step of the drying reaction, and the drying reaction continues for a certain period of time even after the drying and curing device has passed, until the final curing or crosslinking is achieved.

The chemical reaction during the drying and curing reaction of the wet ink film is in particular a UV polymerization. The wet ink film consists of color pigments, binders, which may be for example monomers or oligomers, and photo-initiators that occur in the form of a double bond in the wet ink film.

When this wet ink film is irradiated by a UV radiation of the drying and curing device, the photo-initiators are activated, wherein the double bond of the photo-initiators are broken by the high-energy UV radiation so that free radicals form.

The free radicals produced by the activation of the photo-initiators then crosslink with the binders, such that the monomers and/or oligomers, form macromolecules. At the end of the curing process, wherein the color pigments are enclosed by the cross-linked monomers and oligomers, the drying operation as a whole is complete.

This process proceeds exothermically, such that the heat energy is released during this process. The UV radiation emitted by the drying and curing device acts only as an initiator, that is to say that the crosslinking process continues even after the drying device has passed so that heat energy emitted from the printed image can be measured at least for a certain period of time after the irradiation by the UV radiation. This heat energy is detected by one or more sensors and is used to ascertain whether a drying reaction has been initiated and/or to ascertain the degree of the drying reaction that has been brought about or the intensity thereof. A detection of the drying and curing reaction and thus a detection of the degree of dryness or curing of the printing ink at the end of the drying and curing reaction or downstream of the drying and curing device is thus possible in a contactless manner. The functioning and quality of the UV emitter is thus also monitored indirectly by the thermosensitive sensor.

In one preferred example of an embodiment of the invention, the sensor is formed by an infrared sensor. By means of this infrared sensor, it is possible to detect heat energy that is emitted from the printed container and is brought about by the drying reaction or the crosslinking. A detection of a plurality of measured values at different locations on the printed image preferably takes place in order to obtain information regarding the curing or crosslinking of the printing ink in different printed image regions.

The sensor preferably has an optical system for the focused detection of the heat energy emitted from the container. By means of the optical system, a selective detection of the heat energy emitted from the container can take place, in particular screening out heat energy emission from other machine elements that heat up during operation, for example the print head, etc. A detection of the heat energy emitted from one printed image region is also possible by means of the optical system, so that different printed image regions can be analyzed separately and independently of one another.

The option comprising optionally one or more suitable lenses enables a clear definition of the detection window or measurement spot in terms of the size in relation to a defined distance of the container surface from the sensor. A specially adapted sensor optical system has the advantage that heat emissions from other heated surfaces (error surfaces), such as for example the surfaces of the print head, can reliably be recognized and distinguished from the container surface to be inspected and the surface of the printed image.

It is also possible that a plurality of sensors are provided, wherein each sensor is assigned to a defined printed image region so that the heat energy emitted from different printed regions can be detected in parallel by different sensors.

In one preferred embodiment, the device has a plurality of container handling stations, wherein each container handling station is assigned an independent sensor. A checking of the degree of dryness or curing of the printed container can thus take place at each container handling station.

In one preferred embodiment, the sensor is provided after the drying and curing device in the movement direction of the container and/or of the printed surface of the container. Therefore, once the drying reaction has been initiated by the drying and curing device, the heat energy emitted from the printed container, in particular from the printed image located on the container, can be detected and evaluated. By virtue of the emitted heat energy, it is preferably possible to deduce the dryness or curing at the end of the drying and curing process even while the drying and curing reaction is still taking place.

Furthermore, the device may preferably be configured in such a way that the container at the container handling station is rotated about its container height axis, and that the sensor is arranged after the drying and curing device, in particular immediately after the drying and curing device, in the direction of rotation. By rotating the container about its container height axis, a relative movement of the container relative to the drying and curing device is achieved. By means of this relative movement, all printed image regions can be acted upon by the drying and curing device. If the sensor is provided after the drying and curing device in the direction of rotation, the heat energy emitted from the container in the region of the printed image can be determined immediately after the activation of the drying and curing reaction.

Preferably, the sensor has an evaluation unit or the sensor is connected to an evaluation unit by means of which the degree of dryness of the printed container can be determined on the basis of the heat energy detected by the sensor. Preferably, the emitted heat energy is detected by the sensor and is deflected towards one or more detectors. In the detector, the heat energy, in particular the energy of the IR radiation, is converted into electrical signals that are then recalculated as temperature values. Proceeding from the determined temperature values and taking account of the time interval between the activation of the drying and curing process and the detection of the heat energy emitted from the container by the sensor, conclusions can be drawn about the degree of dryness or curing of the printing ink at the end of the drying and curing process, since the heat energy emitted from the container is directly dependent on the degree or intensity of the activation of the drying and curing reaction of the printing ink. For the case of low activation of the drying and curing reaction, only a low heat energy is emitted from the container in the region of the printed image, whereas, in the case of strong activation of the drying and curing reaction, a considerably greater heat energy is emitted from the container in the region of the printed image. The evaluation unit may be designed to determine the degree of curing as a function of the determined temperature values and/or the emitted heat energy, that is to say that the curing of the printed image after completion of the drying and curing process can be deduced by means of the evaluation unit from the temperature values measured after activation of the drying reaction. If insufficient activation of the drying and curing process is ascertained, the evaluation unit or a control unit connected thereto can, for example, actuate the drying and curing devices in such a way that the activation intensity is increased, that is to say for example the UV radiation intensity is increased. Failures of drying and curing devices can also be detected in this way. Furthermore, it is possible to separate out insufficiently cured containers, in a suitable manner, in the further course of the transport path.

In one preferred example of an embodiment of the invention, the degree of dryness is determined whilst taking into account at least one reference measured value. The reference measured value is in particular the temperature of the container prior to activation of the drying reaction. This reference value can preferably also be determined by the sensor. Based on the reference value, a temperature difference between the temperature prior to activation of the drying and curing reaction and the temperature after activation of the drying and curing reaction can thus be determined. In particular, a temperature rise in the region of the printed image can be detected by means of the sensor. This temperature rise brought about by the activation is at least 25-35° C., wherein the original temperature depending on the ink is usually in the range from 30 to 45° C.

Based on this temperature rise, it is possible to deduce the degree of activation of the drying and curing reaction.

As a particular side-effect, it is also possible to tell from the temperature curve whether any printing has taken place at all because, if there is no print, no temperature rise or only a subtle temperature rise takes place.

The drying and curing device may be an integral part of a printing device or of the printing stations thereof for printing the containers, or said device may be arranged downstream of a printing device or printing station. In particular, the drying and curing device and the sensor may each be provided in the region of the printing stations of the printing device. Alternatively, a drying and curing device may be provided downstream of the printing device, in which drying and curing device the drying of the containers printed by the upstream printing device takes place.

The drying and curing device is preferably a UV lamp. The UV lamp emits UV radiation by means of which the double bond of photo-initiators located in the printing ink can be broken. Once the double bond has been broken, the photo-initiators can launch a drying and curing reaction, which leads to complete crosslinking of the printing ink. This drying and curing reaction launched by the UV radiation proceeds exothermically, that is to say that heat energy is released, wherein the degree (level) and also the progress of the heating over time correlates with the degree of dryness and curing of the printing ink or coating liquid.

The invention also relates to a method for determining the degree of dryness of printed containers, comprising a transport element that can be driven in rotation and that has container handling stations, wherein the containers held at the container handling stations are moved by the transport element on an intrinsically closed movement path between at least one container feed and at least one container discharge, and wherein each container handling station is assigned at least one drying and curing device, by means of which a drying reaction is brought about on the printed containers. In order to determine the degree of dryness, the heat energy emitted from the container subjected to the drying and curing reaction is detected by means of a sensor. Advantageously, in this method, prior to the drying and curing step, the heat emission from the container surface or parts thereof is detected as a reference value. In this way, different pre-heating of the container surface or of the ink applications can be detected and included in the evaluation.

In one preferred example of an embodiment of the invention, the drying and curing devices bring about an exothermic drying and curing reaction on the printed container and the sensor determines the heat energy that is emitted from the container and is brought about by the exothermic drying reaction.

Furthermore, the degree of dryness of the printed container after completion of the drying reaction is preferably determined on the basis of the heat energy detected by the sensor during the course of an exothermic drying reaction brought about by the drying and curing device.

In a further embodiment, the degree of dryness and curing of the printed container is determined while taking account of the temperature of the printed container prior to the initiation of the drying and curing reaction.

In the context of the invention, containers are, for example, bottles, cans, tubes or pouches, in each case made of metal, glass and/or plastic, that is to say for example including PET bottles, but also other packaging means, particularly those suitable for filling with liquid or viscous products.

In the context of the invention, the expression "substantially" or "approximately" means deviations of +/−10%, preferably +/−5%, from the exact value in each case and/or deviations in the form of variations that do not affect the function.

In an alternative embodiment, one or more sensors are arranged in a stationary manner, such that they do not move in rotation or in the direction of the transport path with the respective container or the handling station, and are arranged in a stationary manner next to or above the transport path of the containers. In this case, this takes place in particular downstream of the angle range or of the transport path on which the printing in one of the printing modules takes place, or at the outlet, for example the outlet star-wheel, of one of the printing modules. In this embodiment, it is also particularly advantageous to provide one or more sensors directly upstream or downstream at the outlet or the outlet element of that module which is configured as the drying and curing module.

The stationary, immovable arrangement in the region downstream of the final drying and curing handling of the containers is a suitable placement site for the sensors and data acquisition particularly in the case of relatively slow-moving systems. In this case, it is advantageous if the container surface to be detected by the sensor is moved counter to the transport direction as the container moves past, by rotating the container about the height axis, so as to lengthen the time available for detection.

However, the sensors may also be provided as part of an inspection module or unit that is arranged downstream, wherein here the heat emission may possibly have already decreased significantly depending on the climatic boundary conditions and consequently the signal could have already been weakened and/or the temperature characteristic may have leveled out.

Further developments, advantages, and possible uses of the invention will become apparent from the following description of nonlimiting examples of embodiments of the invention and from the figures. All the features described and/or shown in the figures per se or in any combination, form in principle the subject matter of the invention, regardless of the way in which they are combined or refer back to one another in the claims. The content of the claims also forms part of the description.

BRIEF DESCRIPTION OF THE FIGURES

The invention will be explained in more detail below with reference to the figures and on the basis of examples of embodiments. In the figures.

DETAILED DESCRIPTION

Figure 1:
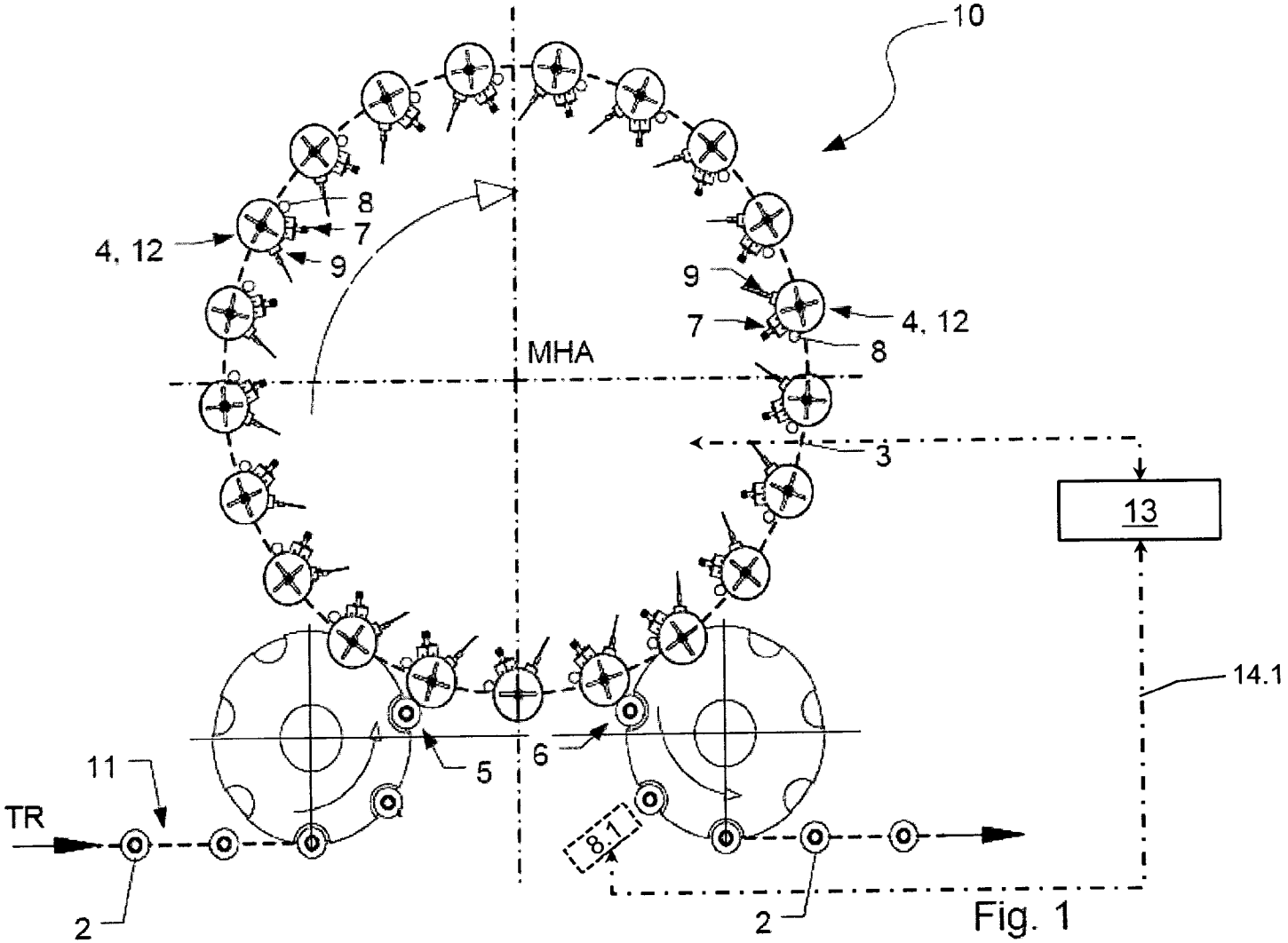
FIG. 1 shows by way of example a device for printing containers in a schematic plan view.

FIG. 1 shows a printing device 10 for printing on containers 2. The printing device 10 uses one or more digital print heads to print multi-colored images thereon. These print heads are inkjet print heads.

A transporter 11 feeds upright containers 2 along a transport direction TR to the printing device 10 in a single-file container stream to a transport star-wheel that defines a container feed 5. The container feed 5 then passes the containers 2 to a transport element 3. In the illustrated embodiment, the transport element 3 includes a rotor that rotates continuously about a vertical machine-axis MHA.

Provided on the circumference of the transport element 3 are container-handling stations 4, each of which has a printing station 12. These container-handling stations 4 are disposed around the vertical machine-axis MHA at equal angular separations from each other.

Each container-handling station 4 includes a container carrier and a printing station 12. The printing station 12 has at least one print head 9 and an ink drier 7 for drying and/or setting ink that has been applied by a print head 9. In a preferred embodiment, the ink drier 7 is a drying and curing device. A container-handling station 4 that is used to print in multiple colors has plural print heads 9, one for each color. In some embodiments, the container carrier suspends a container from a region at or near its mouth or opening.

Printing takes place as the transport element 3 moves the container 2 along a transport path between the container feed 5 and the container discharge 6. As the transport element 3 moves the container, a container-rotation device also rotates the container about its container axis relative to the print head 9. This permits the print head 9 to print along the container's circumference. The ink drier 7 dries and/or cures the freshly applied ink. As a result, it is possible to conduct the container 2 out at the container discharge 6 and to convey it away without a significant risk of damaging the printed image applied thereto.

The ink drier 7 is arranged after the print head 9 in the container's rotation direction. This means that as the container 2 rotates about its container height axis, the recently printed image moves past the ink drier 7. As it does so, the ink drier 7 subjects it to a drying operation or activates an exothermic drying reaction.

Sensors 8, as well as the other elements, connect to an evaluation unit 13 via data connections 14.1. In some embodiments, a stationary sensor 8.1 acts as a detection unit in the transport region of the outlet star-wheel 30 in FIG. 1.

Figure 2:
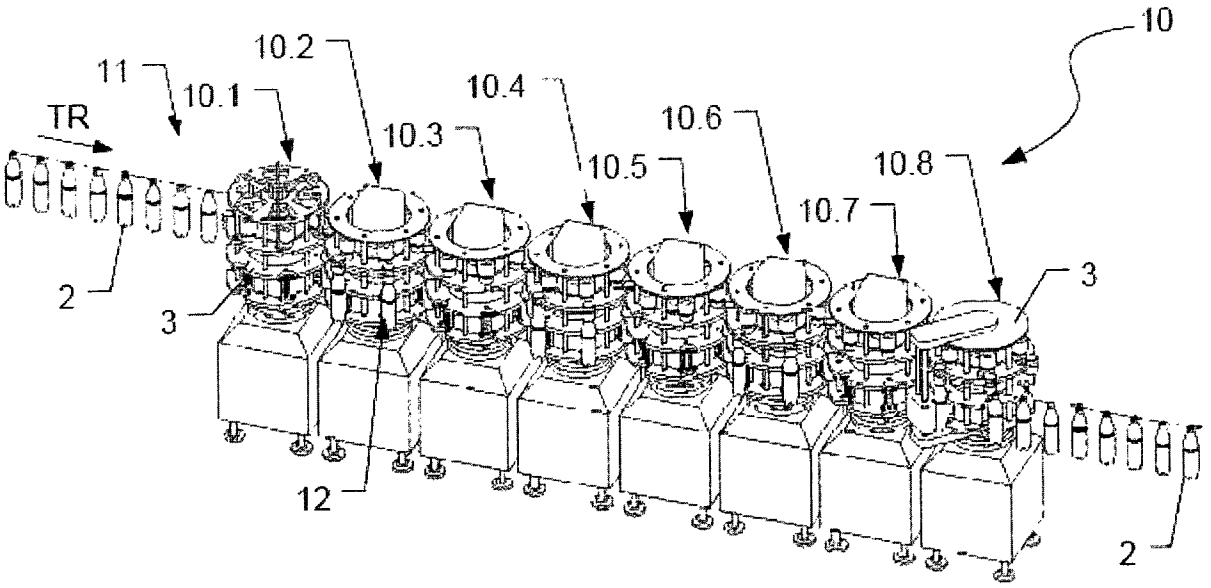
FIG. 2 shows by way of example a further device for printing containers in a schematic perspective view.

In the embodiment shown in FIG. 2, an external transporter feeds upright containers 2 to the printing device 10 along a transport direction TR. Within the printing device 1, the containers 2 follow an undulating transport path. After having been printed upon, the containers 2, which are still upright, are then delivered via an external transporter for further use.

The printing device 10 shown in FIG. 2 includes a successive modules **10.1-10.*n* arranged next to each other along a transport direction. In the illustrated embodiment, there are eight such modules 10.1-10.8. Preferably, to form a module 10.1-10.8, one starts with the same basic unit and adds on whatever additional functional elements that module 10.1-10.8** would need to carry out its specific task.

The basic unit that one starts with to form a module 10.1-10.8 includes a transport element 3, which can be a transport star-wheel or process star-wheel. This transport element 3 is drivable so that it can rotate about a vertical machine-axis of the module 10.1-10.8. The transport element 3 has holders arranged around its circumference. These holders are separated from each other along the circumferential direction by equal angles. Each of these holders secures one container 2.

The transport elements 3 of the individual modules 10.1-10.8 are arranged to form an undulating transport path through the printing device 10. In particular, the transport element **10.*m* of the $m^{th}$ module is placed immediately next to the transport element of the $(m+1)^{th}$ module 10.(*m*+1) where m is an integer in the set {1, 2, . . . n}. These adjacent transport modules 10.*m*, 10.(*m*+1) are then driven synchronously but in opposite directions. As a result of this arrangement, the transport elements 10.1-10.8 cooperate to define an undulating path with multiple bends between a container feed 5 at one end of the device 10 and a container discharge 6 at the opposite end of the device 10. A container 2 is thus passed directly from a transport element 3 of one module 10.*m* to a transport element of a successive module 10.(*m*+1)** that lies next to it along the transport direction.

The printing device 10 can be assembled in a modular manner. In the illustrated embodiment, the first module 10.1 is an inlet module, or container feed 5. In some embodiments, the first module 10.1 may also carry out certain steps associated with pre-handling the containers 2. The second through fifth modules 10.2-10.5 that follow the first module 10.1 are printing modules that carry out the multicolor printing. Each of the second through fifth modules 10.2-10.5 prints one color. In this case, the second through fifth modules each print in a color selected from the group consisting of yellow, magenta, cyan and black. The sixth module 10.6 functions as the ink drier 7. It operates by providing energy, such as heat or UV radiation. In the illustrated embodiment, the seventh module 10.7 is an inspection module that checks for errors on incoming containers and ejects them if necessary. The ejection occurs either at the seventh module 10.7 or further downstream. Finally, the eighth module 10.8 forms the outlet module at which the finished printed containers 2 leave the device 10. However, in some embodiments, the eighth module 10.8 can be an ink drier 7.

In the embodiment shown in FIG. 2, some of the modules rotate containers about their container axes during handling. In particular, each of the second through fifth modules 10.2-10.5 rotates containers relative their respective print heads 9 to permit printing along the circumferences thereof. Similarly, at the sixth module 10.6, container holders rotate the container for more effective exposure to a source of energy for drying ink.

The embodiments shown in FIGS. 1 and 2 each include a sensor 8 disposed downstream of the ink drier 7. This sensor 8 makes it possible to obtain information concerning the drying process. In some embodiments, the sensor 8 is arranged after the ink drier 7 in the transport direction TR. In other embodiments, the sensor 8 is assigned to a container handling station 4, for example to a printing station 12 or a drying station of a drying and curing module 10.6 at which the ink driers 7 are also provided.

FIG. **3*a* shows an example of a container-handling station 4. The container-handling station 4 can be a printing station 12 according to the printing device 10 of FIG. 1, but with the print head 9 having been omitted. Or, the printing station 12 can be a drying station such as one that would be present in the sixth module 10.6 of the embodiment shown in FIG. 2**.

A retainer fixes the container 2 at the container-handling station 4. This retainer also rotates the container 2 about its container axis along a rotation direction DR. A suitable retainer is one that clamps the container between its top and bottom, or one that suspends it from a region at or near its mouth.

As the retainer rotates the container, it exposes freshly-printed regions to the ink drier 7. These are regions at which the ink has not yet been dried or cured. The ink drier 7, which can be a UV source, then initiates an exothermic drying or curing reaction at the freshly-printed region.

Further rotation moves the printed image past the sensor 8. In some embodiments, the sensor 8 is a heat-detecting sensor, an example of which is an infrared sensor. In such cases, the sensor 8 senses heat energy emitted from the container 2 that bears the ink that is being dried. In particular, the sensor 8 determines the absolute temperature of printed-image regions.

As mentioned above, at least one heat-detecting sensor 8 is arranged in the region of the handling stations 4 of the containers 2 on a drying-and-curing module 10.6 and is moved therewith in the transport direction TR. Such an arrangement is also shown in FIG. 3*b*. In this case, the two ink driers 7 are UV light sources. The heat sensor 8 is arranged between these ink driers 7.

The heat sensor 8 is useful because chemical reactions associated with drying the ink release heat. The reaction does not stop once the radiation stops. It continues for some time after exposure of radiation, releasing heat as it does so. This heat provides a basis for evauluating the quality of the drying and curing operations downstream of the radiation source.

In some embodiments, the sensor 8 has a narrow field of view so that the heat emitted from the container 2 can accurately be detected. As a result, the sensor 8 detects almost exclusively heat energy or infrared radiation that is emitted from the container 2. This means that its results are not corrupted by infrared radiation that is emitted from other sources nearby.

In some embodiments, the sensor 8 responds to received heat energy in a matter of milliseconds, for example in the range between 50 milliseconds and 1 millisecond, preferably in a range less than 10 milliseconds, in particular from 2 milliseconds to 6 milliseconds. This means that as the printed image moves past the sensor 8, it is possible to measure heat emitted from different points of the printed image. This also means that it is possible to detect different degrees of dryness in different regions of the printed image.

The ability to detect the extent of drying in different image regions is particularly useful because curing may proceed by different extents at different points in the printed image. By way of example, the uniform action of the ink drier 7 on the entire printed image leads to a reduced curing in printed image regions containing white printing ink. This is because white printing ink reflects more of the UV light that is emitted from the ink drier 7. As a result, the photo-initiators are not activated as extensively. This leads to poorer drying and curing.

By virtue of the separate detection of the heat energy emitted from different printed image regions, it is thus possible to determine the degree of activation of the drying reaction for different printed image regions and thus to draw conclusions about the overall degree of curing.

Figure 3A:
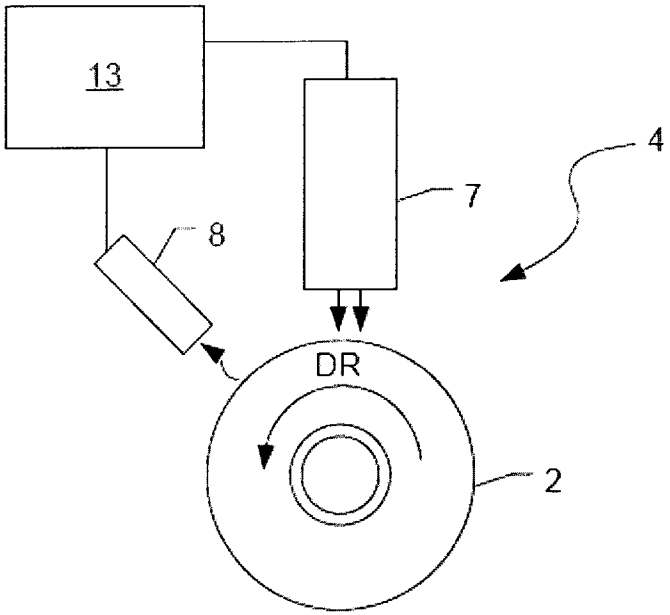
FIGS. 3*a,b* show by way of example handling stations of a drying device in a schematic plan view.
Figure 3B:
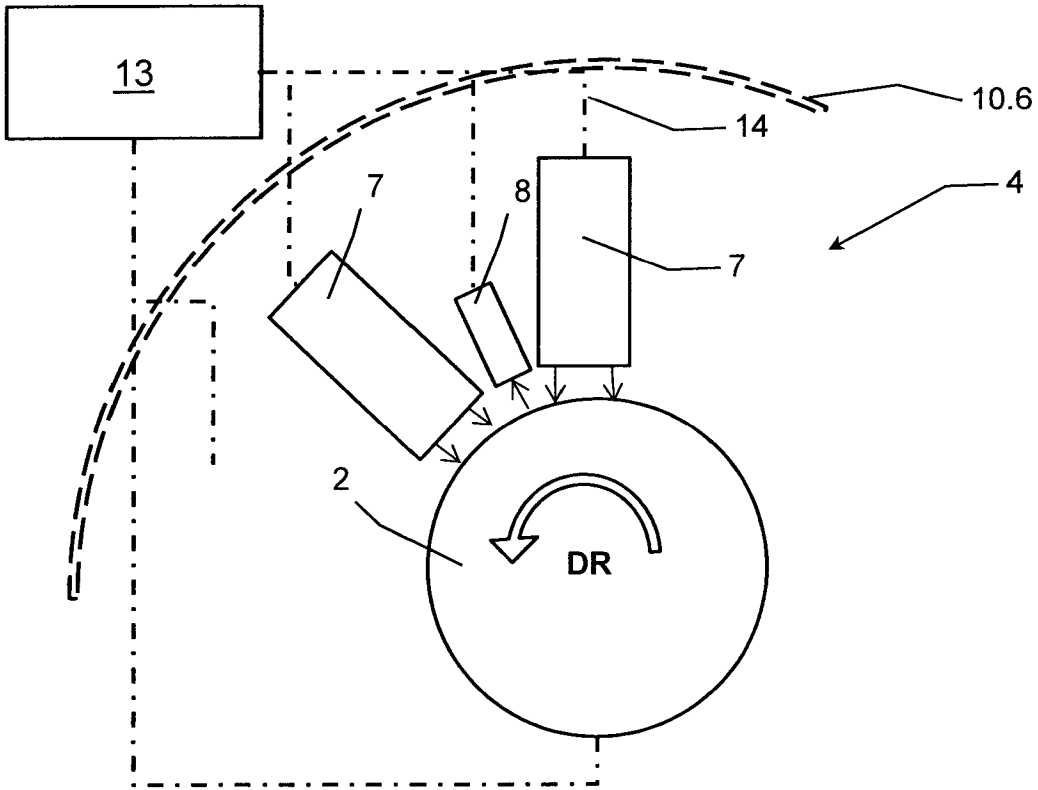

As shown by way of example in FIG. 3, the sensor 8 is coupled to an evaluation unit 13. As a result, measured values detected by the sensor 8 can be forwarded to the evaluation unit 13 and analyzed or evaluated therein.

The evaluation unit 13 makes it possible to determine the extent to which the ink drier 7 has activated the drying reaction or curing reaction. In some embodiments, the evaluation unit 13 couples to the ink drier 7. This permits adjustment of the ink drier's power output as a function of the extent to which activation has proceeded. In some embodiments, this permits adaptive control of the emitted UV energy. For example, if the evaluation unit 13 detects a disappointingly weak curing reaction, it increases the ink drier's power output. Conversely, if the evaluation unit 13 detects an alarmingly vigorous curing reaction, it reduces the ink drier's power output.

Figure 4:
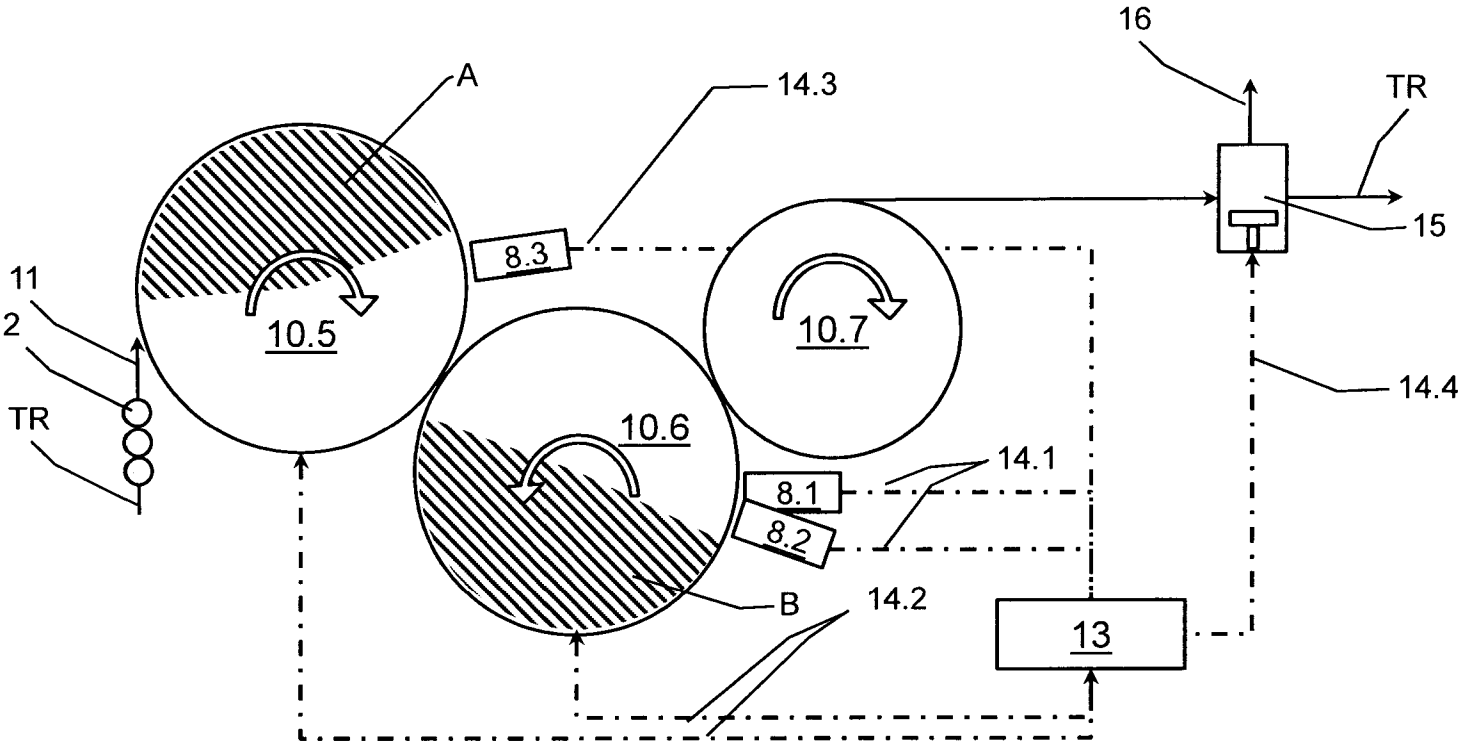
FIG. 4 shows by way of example a stationary sensor arrangement at the end of the drying and curing module.

In an alternative embodiment, shown in FIG. 4, containers 1 are printed on one or more printing modules, of which only a first module 10.5 is shown. Downstream of the first module 10.5 is a second module 10.6. The second module 10.6 is an independent drying-and-curing module on which the containers 2, as they are transported in the transport direction TR in the angle range B, are subjected to a final drying and/or curing process by means of radiation emitters to cure the ink. In some embodiments, the emitters include one or more UV emitters.

First and second IR sensors 8.1, 8.2 are placed after an angular range B in the region of the second module's outlet. These first and second IR sensors 8.1, 8.2 are stationary and do not rotate. In the illustrated variant, the first and second IR sensors 8.1, 8.2 are arranged at different vertical heights. The first and second sensors 8.1, 8.2 therefore detect heat from two vertically offset positions.

The first and second sensors 8.1 and 8.2 connect to the evaluation unit 13 via first and second data connections 14.1. 14.2. In the embodiments described herein, the first and second data connections 14.1, 14.2 are implemented as either a wired or wireless transmission system that allows a sufficiently fast and secure data transmission.

An inspection module 10.7 for detecting faulty containers 2 lies downstream of the drying and curing module 10.6. In the downstream direction TR from the inspection module 10.7, an adjoining ejection device 15 ejects any of these faulty containers 2 via an ejecting path 16. The inspection module 10.7 and the ejecting device 15 are likewise connected to the evaluation device 13 and/or to another central control unit via the first and second data connections 14.4, 14.5.

The embodiment shown in FIG. 4 includes a non-rotating, and hence stationary sensor 8.3. The stationary further sensor 8.3 is arranged in the outlet region of the printing module 10.5, namely downstream of the angle range A of the printing module 10.5 within which containers are printed upon. A third data connection 14.3 connects the stationary sensor 8.3 to the evaluation unit 13.

This stationary sensor 8.3 detects and monitors heat emission from the container surface or from the printed image. Such heat emission results from a pre-drying and/or partial drying or from the pinning process, which is carried out immediately after the printing module 10.5 prints.

To promote inspection reliability, therefore, the measured values of the first and second sensors 8.1, 8.2 and those of the upstream sensor 8.3 may be evaluated jointly.

In some embodiments, the process of determining an extent of drying or curing includes having the sensor 8 determine a reference value. This value could be a reference temperature that corresponds to the container's temperature prior to activating the ink drier 7. One then determines a difference between this reference temperature and a measured temperature of the printed image after having been run through the ink drier 7. The difference between these temperatures directly provide information representative of the extent to which the drying or curing reaction has been activated, and hence, the extent to which the printed image is dried or cured at the end of this drying or curing reaction.

Figure 5:
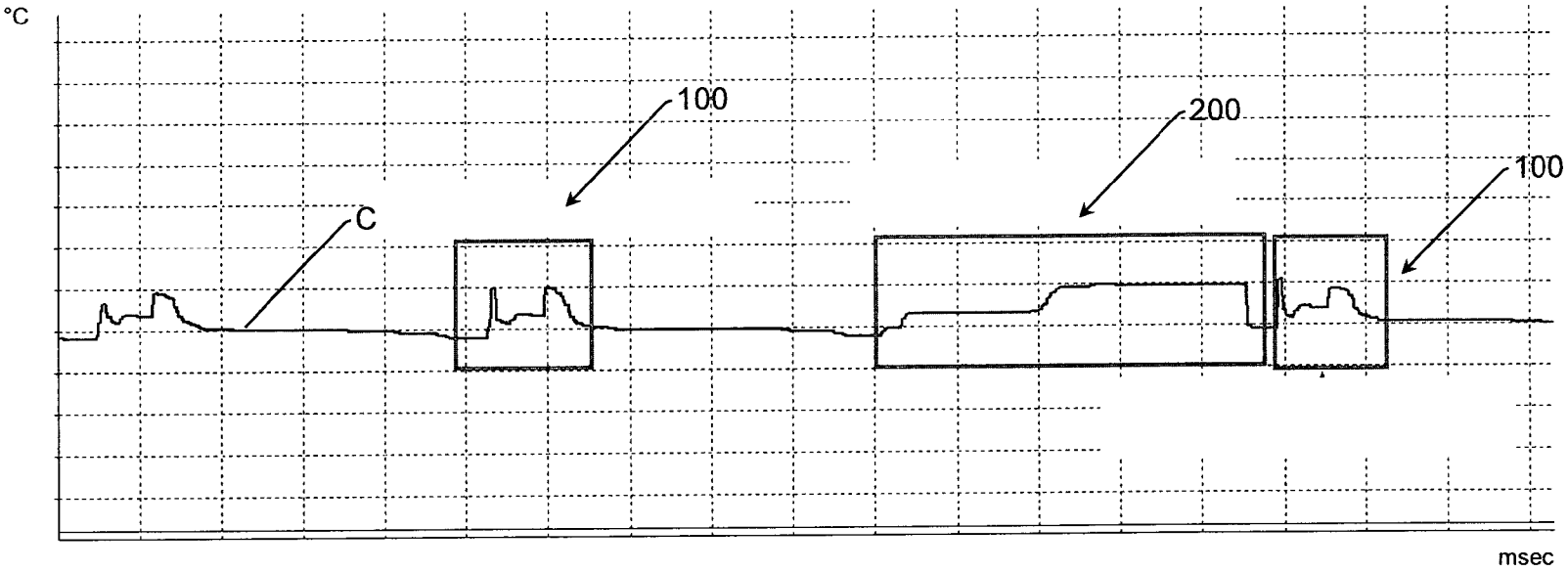
FIG. 5 shows by way of example a representation of the temperature/time curve (example 1)
Figure 6A:
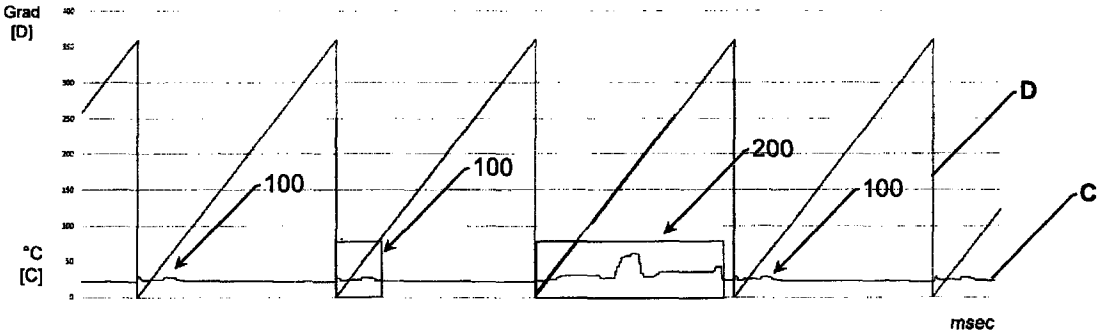
FIGS. 6*a,b* show by way of example representations of temperature/time curves (example 2).
Figure 6B:
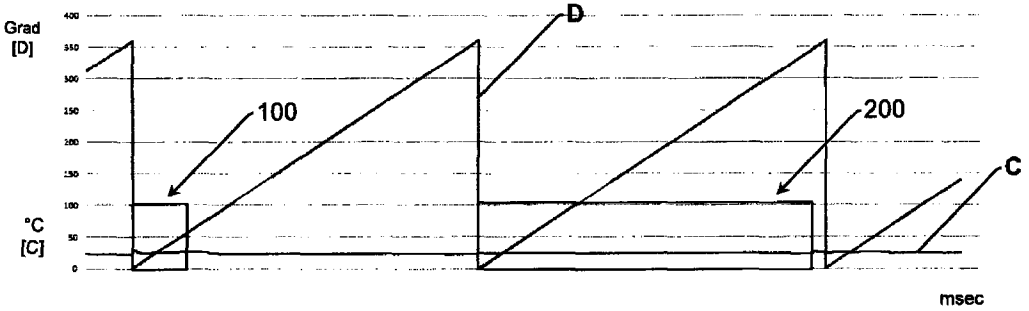

FIGS. 5 and 6*a*, 6*b* show the measured values measured by two different IR sensors in the case of a structure corresponding to that in FIG. 3*b* with just one sensor 8.

In example 1 shown in FIG. 5, an IR sensor of type 1 is used. Such a sensor has the following performance data:

| | |
|---|---|
| Spectral sensitivity | 8-14 micrometers |
| Optical resolution | 15:1 |
| CF optic (lens) | 0.8 millimeter measurement spot diameter at distance of 10 millimeter |
| Temperature resolution | 0.1 Kelvin |
| Response time | 30 milliseconds for 90% of the signal |

A single-colored printed image was applied to the containers in a single-pass method and the UV-curable printing ink was subjected to a drying and curing process lasting for at most 800 milliseconds. In the particular example shown, this process lasted 792 milliseconds. Detection by the IR sensor of type 1 took place in parallel for at least 3.3 milliseconds per degree of angle with active UV lamps. In the process, 360° of the container surface to be inspected were moved past the stationary type-1 IR sensor.

The temperature curve C shown in FIG. 5 shows essentially first and second prominent curve sections 100, 200, which can be discretely distinguished from one another by choosing the type-1 sensor with a very fast and scalable analog output and real-time data processing.

The second curve section 200 is the detection area of the printed image on the container surface. This is the curve and measurement area of interest. In contrast, the first curve section 100 is the curve of the heat emission of print heads of adjacent modules, which enter the detection area of the highly sensitive sensor. Each surface has its own curve characteristic for the 360°, here in particular regarding the absolute temperature, duration of sub-sections of individual temperature levels and peek characteristic, which can be clearly determined in real time and assigned via the evaluation unit 13.

Since the response time for the type-1 sensor lies in the region of 30 milliseconds for 90% of the signal, a certain signal delay occurs. This leads to the plateau-like temperature curve shown in the second curve section 200. The curve characteristics of the first curve section 100 and second curve section 200 are nevertheless specific, so that the complete thermal nominal data for the drying and curing process can be reliably detected and distinguished.

A particular advantage of the device and of the method described herein is that the temperature, and thus the drying and curing quality, can be reliably determined and evaluated in real time for each angular degree of the container surface. This can be done without any limitations concerning the transport speed and thus the output of the system as a whole. In the present case, the starting temperature of the surface has been detected prior to the drying and curing handling and the data is reset accordingly.

FIGS. 6*a* and 6*b* show temperature curves according to example 2, wherein use was made of a type-2 IR sensor having the following performance data. This type-2 IR sensor differs from the type-1 IR sensor in particular by its faster detection speed. It achieves 90% of the output signal after just 6 milliseconds. The test set-up and the process times correspond to those of example 1.

| | |
|---|---|
| Spectral sensitivity | 8-14 micrometers |
| Optical resolution | 15:1 |
| CF optic (lens) | 0.8 millimeter measurement spot diameter at distance of 10 millimeter |

-continued

| | |
|---|---|
| Temperature resolution | 0.2 Kelvin |
| Response time | 3 milliseconds for 50% and 6 milliseconds for 90% of the signal |

In a manner analogous to FIG. 5, FIG. 6*a* shows the temperature curve over time on the container surface as detected by the type-2 IR sensor. The zigzag curve D in FIGS. 6*a* and 6*b*, show the angle positions from 0° to 360° of the container plotted on the vertical axis as a function of time. The linear slope arises from the container's fixed rotational speed.

As can be seen in curve section C of FIG. 6*a*, given a substantially identical test set-up as example 1, the result is a more detailed temperature curve around the printed image and a more precise determination of the temperature levels achieved.

A type-1 sensor is thus particularly suitable for detecting the presence of the printed image and also the successful progress of the drying and curing process. To obtain quantifiable information about the quality of the drying and curing process a type-2 sensor is preferred.

Other embodiments also detect the temperatures of a surface other than that of the container. In these embodiments, an appropriately oriented sensor with a lens system focuses infrared radiation from the surface whose temperature is of interest. This is useful in particular for monitoring the print head to ensure that it is operating at its expected operating temperature.

FIG. 6*b* shows a curve according to example 2 when no printed image has been applied to the container. This means, of course, that there is no drying and curing process, and hence no associated heat emission. This curve is useful since it matches what one might expect if ink has been applied by the print heads, but the drying and curing process has not been started. This might arise, for example, from a defect of the drying and curing emitter. The resulting curve would be a very even, plateau-like mean temperature curve matching that shown. This makes it possible to detect this type of fault.

It is also clear from FIGS. 5 and 6*a* that the thermographic detection of the container surface can take place in one single pass, in that the surface of the container, in the case of one of the sensors 8, is rotated through 360° in front of this sensor and, if two UV emitters are used as shown in FIG. 3*b*, is rotated through 360° plus the angle spacing between the two emitters, so that both UV emitters and the respective radiation effect are detected.

It is quite generally possible, in all the aforementioned variant embodiments, to provide a permanent data acquisition by the sensor 8 or to record thermographic values only at discrete angle values or ranges of the container surface. This may be particularly advantageous when containers are printed only in narrow angle ranges.

The invention has been described above on the basis of examples of embodiments of rotating transport and handling devices. It will be understood that the sensors and the monitoring process can also be used with advantage in the case of linear transport and handling devices, even in the case of systems operating in steps.

The invention claimed is:

1. An apparatus comprising a drivable transport element, a container-handling station, a container feed, a container discharge, a control-and-evaluation unit, a drying-and-curing device, and a sensor, wherein said transport element moves said container-handling station along a movement path between said container feed and said container discharge, wherein said container-handling station comprises said drying-and-curing device and said sensor, wherein said drying-and-curing device causes an exothermic reaction on said container, wherein said sensor is configured to detect emitted heat energy from said exothermic reaction during a sensing interval that is between 50 milliseconds and 1 millisecond per angular degree of said container surface.

2. The apparatus of claim 1, wherein said sensor is disposed to detect emitted heat energy from a surface at a module that is configured to at least one of dry ink and cure ink.

3. The apparatus of claim 1, wherein said sensor comprises an infrared sensor.

4. The apparatus of claim 1, wherein said sensor is disposed downstream, along said drying-and-curing device such that a container encounters said drying-and-curing device before encountering said sensor.

5. The apparatus of claim 1, wherein said sensor comprises an optical system, wherein said optical comprises at least one lens, and wherein said optical system is configured to direct heat emitted from said container to said sensor.

6. The apparatus of claim 1, wherein said a container-handling station is one of a plurality of identical container-handling stations, wherein sensors in said container-handling stations operate independently of each other.

7. The apparatus of claim 1, wherein said a container-handling station is configured to rotate a container in a first direction, said first direction defining a downstream direction, and wherein said sensor is disposed immediately downstream of said drying-and-curing device along said downstream direction.

8. The apparatus of claim 1, wherein said sensor is configured to provide, to said evaluation unit, information leading to a determination of an extent of dryness of a printed container based at least in part on heat energy detected by said sensor.

9. The apparatus of claim 8, wherein said evaluation unit is configured to determine said extent of dryness at least in part on the basis of a reference measured value.

10. The apparatus of claim 1, further comprising a printing device for printing on containers, wherein said container handling device is arranged downstream of said printing device.

11. The apparatus of claim 1, wherein said drying-and-curing device comprises a UV lamp.

12. A method comprising determining an extent of dryness of printed containers, wherein determining said extent of dryness includes holding a container having a printed region that has been printed upon, using said transport element, moving said container along a movement path between a container feed and a container discharge, causing an exothermic reaction on said printed region, said reaction being one of a drying reaction and a curing reaction, and during a sensing interval that lasts no more than fifty milliseconds for each angular degree of said printed region, sensing heat energy emitted as a result of said reaction.

13. The method according to claim 12, further comprising causing said sensing interval to be between one millisecond and ten milliseconds.

14. The method of claim 12, wherein sensing comprises sensing heat energy after said exothermic reaction has been initiated.

15. The method of claim 12, further comprising determining an extent of dryness of said printed region at least in part on detected heat energy.

16. The method of claim 15, wherein determining an extent of dryness of said printed region comprises determining said extent at least in part based on a measured temperature of said printed region prior to initiation of said exothermic reaction.

17. The method of claim 12, further comprising determining whether said exothermic reaction has been correctly initiated based on heat detected from a surface other than said printed region.

18. The method of claim 12, further comprising determining whether said exothermic reaction has been correctly initiated based at least in part on heat detected from a surface of a print head.

19. The method of claim 12, further comprising using information derived from sensing said heat energy as a basis for determining that said printed region is insufficiently dry, and executing a step selected from the group consisting of ejecting said container and subjecting said container to further treatment.

20. The method of claim 12, further comprising using information derived from sensing said heat energy as a basis for controlling drying.

21. The method of claim 12, further comprising, prior to drying said printed region, detecting a temperature of a region of a target, wherein said target is selected from the group consisting of a surface of said container and ink on said surface.

* * * * *